US007731481B2

(12) United States Patent
Cunha et al.

(10) Patent No.: US 7,731,481 B2
(45) Date of Patent: Jun. 8, 2010

(54) AIRFOIL COOLING WITH STAGGERED REFRACTORY METAL CORE MICROCIRCUITS

(75) Inventors: Francisco J. Cunha, Avon, CT (US); Edward F. Pietraszkiewicz, Southington, CT (US)

(73) Assignee: United Technologies Corporation, Hartford, CT (US)

( * ) Notice: Subject to any disclaimer, the term of this patent is extended or adjusted under 35 U.S.C. 154(b) by 722 days.

(21) Appl. No.: 11/641,628

(22) Filed: Dec. 18, 2006

(65) Prior Publication Data

US 2008/0145235 A1 Jun. 19, 2008

(51) Int. Cl.
*F01D 5/18* (2006.01)

(52) U.S. Cl. ..... 416/97 R; 415/115; 29/889.721

(58) Field of Classification Search ..... 415/115; 416/97 R; 29/889.721

See application file for complete search history.

(56) References Cited

U.S. PATENT DOCUMENTS

| | | | | |
|---|---|---|---|---|
| 5,370,499 | A * | 12/1994 | Lee | 416/97 R |
| 5,383,766 | A * | 1/1995 | Przirembel et al. | 416/97 A |
| 5,392,515 | A * | 2/1995 | Auxier et al. | 29/889.721 |
| 5,690,472 | A * | 11/1997 | Lee | 416/97 R |
| 6,514,042 | B2 * | 2/2003 | Kvasnak et al. | 416/97 R |
| 6,832,889 | B1 * | 12/2004 | Lee et al. | 415/115 |
| 6,981,840 | B2 * | 1/2006 | Lee et al. | 415/115 |
| 7,011,502 | B2 * | 3/2006 | Lee et al. | 416/97 R |
| 7,131,818 | B2 * | 11/2006 | Cunha et al. | 416/97 R |

* cited by examiner

*Primary Examiner*—Igor Kershteyn
(74) *Attorney, Agent, or Firm*—Bachman & LaPointe, P.C.

(57) ABSTRACT

A turbine engine component has an airfoil portion with a pressure side wall and a suction side wall and a cooling system. The cooling system has at least one cooling circuit disposed longitudinally along the airfoil portion. Each cooling circuit has a plurality of staggered internal pedestals for increasing heat pick-up.

33 Claims, 4 Drawing Sheets

AIRFOIL COOLING WITH STAGGERED REFRACTORY METAL CORE MICROCIRCUITS

BACKGROUND OF THE INVENTION (1) Field of the Invention

The present invention relates to an improved cooling system for an airfoil portion of a turbine engine component and to a method of making same.

(2) Prior Art

Existing designs of turbine engine components, such as turbine blades, formed using refractory metal core (RMC) elements have peripheral cooling circuits placed around the airfoil portion of the turbine engine components to cool the airfoil portion metal convectively. FIG. 1 illustrates a pressure side view of one such turbine engine component, while FIG. 2 illustrates a suction side view of the turbine engine component. In some instances, the axial internal cores end in film cooling slots. The combination of film and convective cooling of peripheral microcircuits lead to significant increases in the overall cooling effectiveness. This in turn leads to extended life capability for the airfoil portion using the same amount of cooling flow as existing cooling design or less.

Existing airfoil configurations are highly three dimensional as illustrated in FIGS. 1 and 2, forming RMC elements to conform to the different airfoil shapes can be difficult, as residual stress tend to spring these core elements back to the undeformed shaped during casting. As a result, positional tolerances may be difficult to maintain during the casting preparation phases, when the wax and the core elements are assembled together. During investment casting, as the liquid metal is introduced in the casting pattern, the temperature that the cores are subject to can lead to deformation of the RMC elements, particularly if residual stress exists due to pre-form conditions.

It is desirable to minimize the consequences of pre-form operations.

SUMMARY OF THE INVENTION

A turbine engine component has an airfoil portion with a pressure side wall and a suction side wall and a cooling system. The cooling system comprises at least one cooling circuit disposed longitudinally along the airfoil portion. Each cooling circuit has a plurality of staggered internal pedestals for increasing heat pick-up.

In one embodiment, the turbine engine component comprises an airfoil portion having a pressure side wall, a suction side wall, a leading edge and a trailing edge, and a plurality of cooling circuits within the airfoil portion. Each of the cooling circuits has a plurality of spaced apart, exit slots extending through the pressure side wall. Each of the cooling circuits further has a plurality of internal staggered pedestals.

A method for forming a turbine engine component is described. The method broadly comprises the steps of forming an airfoil portion, and said forming step comprising forming at least one cooling circuit extending longitudinally within the airfoil portion and having at least one exit slot extending through a pressure side wall of the airfoil portion.

Other details of the airfoil cooling with staggered refractory metal core microcircuits of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
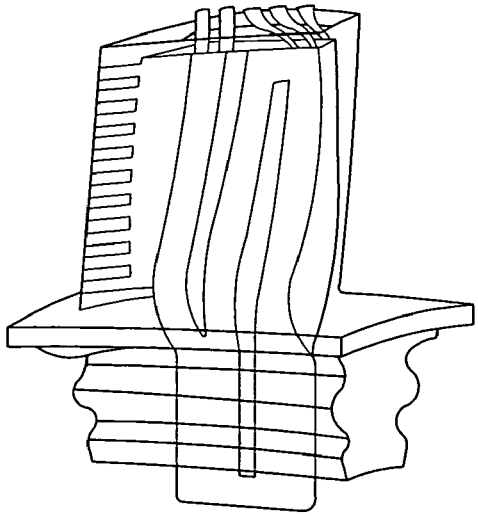
FIG. 1 PRIOR ART
FIG. 1 illustrates a pressure side view of a prior art turbine engine component.
Figure 2:
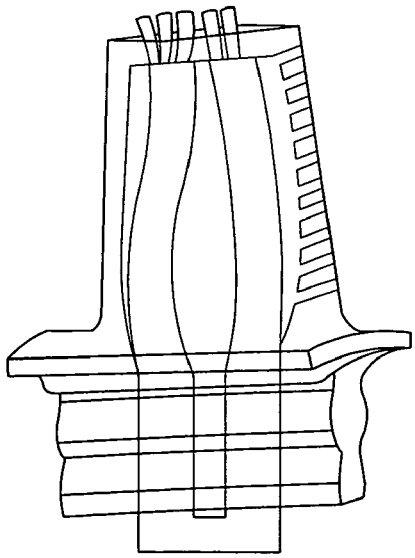
FIG. 2 PRIOR ART
FIG. 2 illustrates a suction side view of the turbine engine component of FIG. 1.
Figure 3:
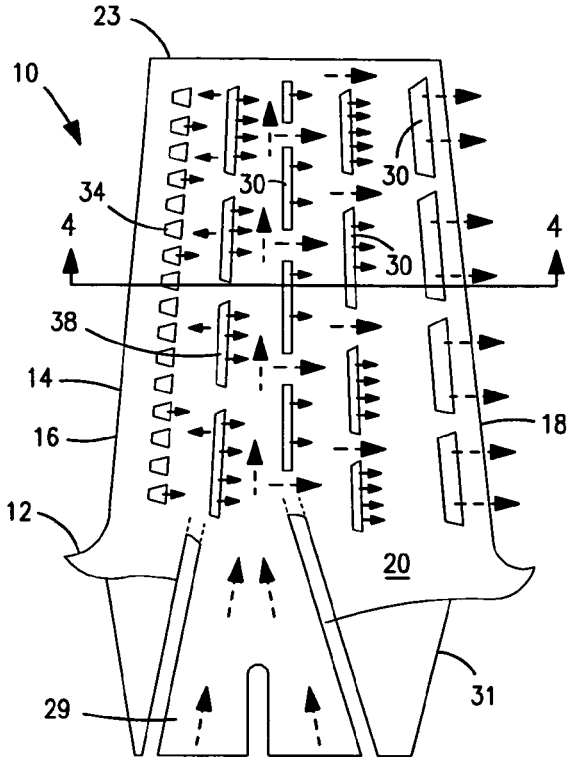
FIG. 3 illustrates a pressure side wall of a turbine engine component.
Figure 4:
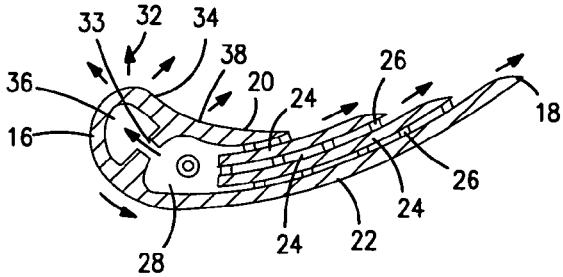
FIG. 4 is a sectional view taken along lines 4-4 of FIG. 3.
Figure 5:
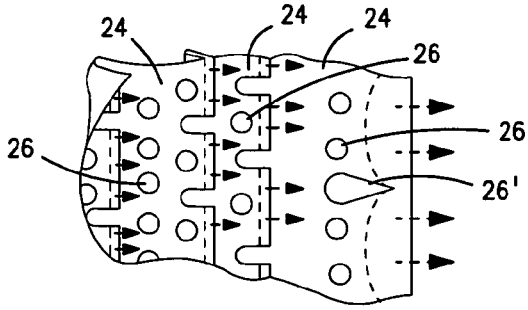
FIG. 5 is an enlarged view of a portion of a plurality of cooling circuits in the turbine engine component of FIG. 3.

Referring now to the drawings, there is illustrated in FIGS. 3-5, a turbine engine component 10 having a platform 12, a root portion (not shown), and an airfoil portion 14. The airfoil portion 14 has a leading edge 16, a trailing edge 18, a pressure side wall 20 extending between the leading edge 16 and the trailing edge 18, and a suction side wall 22 extending between the leading edge 16 and the trailing edge 18.

Figure 6A:
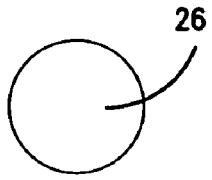
FIG. 6A shows a first embodiment of a pedestal which can be used in a cooling microcircuit.
Figure 6B:
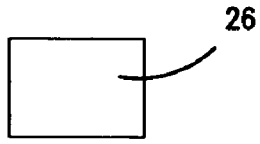
FIG. 6B shows a second embodiment of a pedestal which can be used in a cooling microcircuit.
Figure 6C:
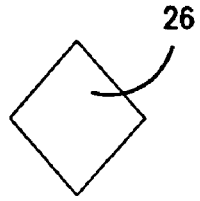
FIG. 6C shows a third embodiment of a pedestal which can be used in a cooling microcircuit.

The airfoil portion 14 has one or more cooling circuits 24 disposed longitudinally along the airfoil portion. Each cooling circuit 24 may extend from a location near a tip portion 23 of the airfoil portion 14 to a location near the platform 12. Further, each cooling circuit 24 is preferably provided with a plurality of staggered pedestals 26. The staggered pedestals 26 may have one or more of the shapes shown in FIGS. 6A-6C. As can be seen in FIG. 6A, the pedestals 26 may be round. As can be seen in FIG. 6B, the pedestals 26 may be rectangular or square. As can be seen in FIG. 6C, the pedestals 26 may be diamond shaped. The staggered pedestals 26 in each cooling circuit 24 create turbulence in the cooling fluid flow in the circuit 24 and hence advantageously increases heat pick-up.

As can be seen from FIG. 4, the cooling circuits 24 each may receive cooling fluid, such as engine bleed air, from a common supply cavity 28 located between the pressure side wall 20 and the suction side wall 22. The supply cavity 28 may also extend from a point near the airfoil portion tip 23 to a point near the platform 12. The supply cavity 28 may communicate with a source of the cooling fluid using any suitable means known in the art such as one or more fluid cavities 29 in a root portion 31 of the airfoil portion 14. Each cooling circuit 24 may have one or more slot exits 30 which allow the cooling fluid to exit over the external surface of the pressure side wall 20. Typically, each cooling circuit 24 has a plurality of spaced apart slot exits 30 which are aligned in a substantially spanwise or longitudinal direction. One of the cooling circuits 24 may also have its slot exit(s) 30 located in the vicinity of the trailing edge 18. The cooling flow exiting from the slot exits 30 is typically distributed by the action of teardrops. In this way, the slot film coverage is considerably high. This yields high values of overall cooling effectiveness for the airfoil portion 12.

The turbine engine component 10 may also have a leading edge cooling circuit 32 having impingement cross-over holes 33 feeding a plurality of shaped film cooling holes 34 formed or machined in the leading edge 16 with the cooling holes 34 extending through the pressure side wall 20. The leading edge cooling circuit 32 may receive a cooling fluid from a leading edge supply cavity 36.

If desired, as shown in FIGS. 3 and 4, the turbine engine component 10 may have one or more additional slot exits 38 machined in or formed in the pressure side wall 20 of the airfoil portion 12. The additional slot exits 38 extend through the pressure side wall 20 and may be located between the shaped cooling holes 34 and a row of slot exits. The exit slot(s) 38 may receive cooling fluid from the supply cavity 28.

Each of the cooling circuits 24 has a plurality of staggered pedestals 26 to enhance the heat pick-up. As shown in FIGS. 4 and 5, the pedestals 26 in each cooling circuit 24 may be offset from the pedestals 26 in the adjacent cooling circuit(s) 24.

As shown in FIG. 5, at least one cooling circuit 24 may have one or more teardrop shaped pedestals 26' if desired.

Figure 7:
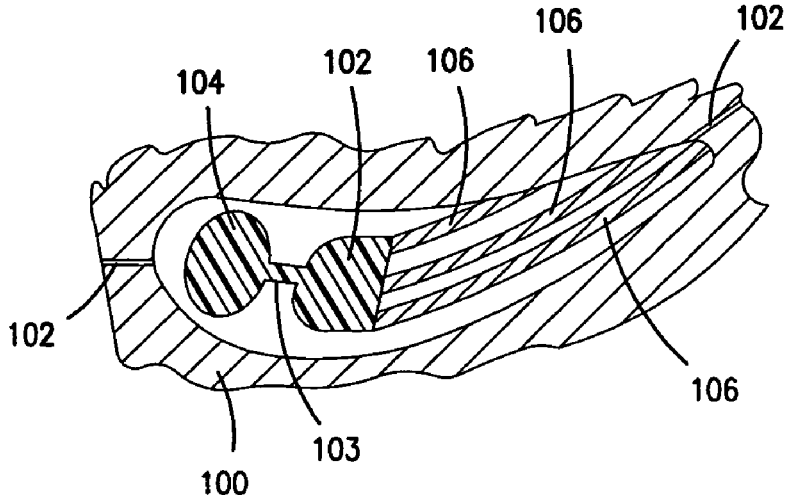
FIG. 7 illustrates a system for casting the airfoil portion of the turbine engine component of FIG. 3.

As shown in FIG. 7, the turbine engine component 10 can be formed by providing a die or mold 100 which splits along a parting line 102. The mold or die 100 is shaped to form the airfoil portion 14. The mold or die 100 may also be configured to form the platform 12 and the root portion 31 (not shown). The portions of the mold or die 100 to form these features are not shown for the sake of convenience.

To form the supply cavities 28 and 36, two ceramic cores 102 and 104 may be positioned within the mold or die 100. To form the cooling circuits 24, one or more refractory metal core elements 106 may be placed within the die or mold 100. Each refractory metal core element 24 may be attached to the ceramic core 104 using any suitable means known in the art.

Figure 8:
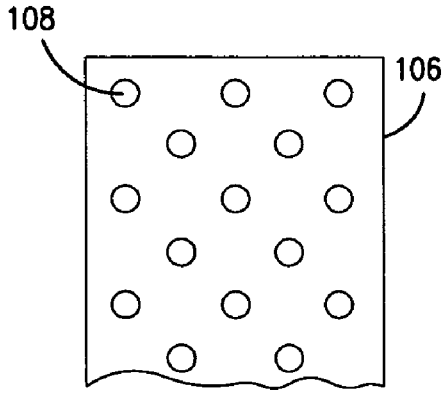
FIG. 8 illustrates a refractory metal core element to be used in the casting system of FIG. 7.

Each refractory metal core element 106 may have a configuration such as that shown in FIG. 8. As can be seen from this figure, the refractory metal core element 106 has a plurality of staggered shaped regions 108 from which the staggered array of pedestals 26 will be formed. Each refractory metal core element has minimal pre-forming requirements as they can be assembled in the pattern with slight deformation to fit the airfoil portion contour. During casting, the pedestals 26 will attain relatively low metal temperature, which enhances the creep capability of the airfoil portion 14.

If desired a wax pattern in the shape of the turbine engine component may be formed and a ceramic shell may be formed about the wax pattern. The turbine engine component may be formed by introducing molten metal into the mold or die 100 to dissolve the wax pattern. Upon solidification, the turbine engine component 10 with the platform 12 and the airfoil portion 14 is present. The ceramic cores 102 and 104 may be removed using any suitable technique known in the art, such as a leaching operation, leaving the supply cavities 28 and 36. Thereafter the refractory metal core elements 106 may be removed using any suitable technique known in the art, such as a leaching operation. As a result, the cooling circuit(s) 24 is/are formed and the pressure side wall 20 of the airfoil portion 14 will have the slot exits 30.

The leading edge cooling holes 34 and the cross-over impingement 33 may be formed using any suitable means known in the art. For example, the cross-over impingement 33 may be formed by a ceramic core structure 103 connected to the core structures 102 and 104. The leading edge cooling holes 34 may be drilled into the cast airfoil portion 14.

The shaped holes 38 may also be formed using any suitable technique known in the art, such as EDM machining techniques.

Forming the turbine engine component using the method described herein leads to increased producibility with simplicity in pre-forming operations. Further, the turbine engine component has increased slot film coverage, leading to overall effectiveness.

The turbine engine component 10 may be a blade, a vane, or any other turbine engine component having an airfoil portion needing cooling.

It is apparent that there has been provided in accordance with the present invention airfoil cooling with staggered refractory metal core microcircuits which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those unforeseeable alternatives, modifications, and variations as fall within the broad scope of the appended claims.

What is claimed is:

1. A turbine engine component having an airfoil portion with a pressure side wall and a suction side wall and a cooling system, said cooling system comprising an arrangement of chordwise overlapping cooling circuits positioned between said pressure side wall and said suction side wall having a plurality of chordwise spaced exit slots, said overlapping cooling circuits each being supplied fluid from a first supply cavity, each said cooling circuit having at least one exit for distributing said cooling fluid over an external surface of said pressure side wall, each said cooling circuit being disposed longitudinally along the airfoil portion, and each said cooling circuit having a plurality of staggered internal pedestals for increasing heat pick-up.

2. The turbine engine component according to claim 1, wherein at least one of said cooling circuits has at least one exit for distributing cooling fluid in the vicinity of a trailing edge of said airfoil portion.

3. The turbine engine component according to claim 1, wherein the staggered pedestals in a first one of said cooling circuits are offset from the staggered pedestals in a second one of said cooling circuits adjacent to said first one of said cooling circuits.

4. The turbine engine component according to claim 1, further comprising a leading edge cooling circuit.

5. The turbine engine component according to claim 4, wherein said leading edge cooling circuit comprises a plurality of cross-over holes feeding a plurality of film cooling holes in a leading edge of said airfoil portion.

6. The turbine engine component according to claim 5, wherein said leading edge cooling circuit receives cooling fluid from said first supply cavity.

7. The turbine engine component according to claim 6, further comprising a second supply cavity for supplying cooling fluid to said at least one cooling circuit and said first supply cavity being in fluid communication with said second supply cavity.

8. The turbine engine component according to claim 7, further comprising at least one additional slot exit formed in said pressure side wall and said at least one additional slot exit being supplied with cooling fluid from the first supply cavity.

9. The turbine engine component according to claim 8, further comprising a plurality of additional slot exits.

10. The turbine engine component according to claim 1, wherein said turbine engine component has a platform and each said cooling circuit extends from a tip of said airfoil portion to a location near said platform.

11. The turbine engine component according to claim 10, wherein said first supply cavity extends from said tip to said location near said platform.

12. The turbine engine component according to claim 1, wherein each of said pedestals has a round shape.

13. The turbine engine component according to claim 1, wherein each of said pedestals has a diamond shape.

14. The turbine engine component according to claim 1, wherein each of said pedestals has a rectangular shape.

15. The turbine engine component of claim 1, wherein said arrangement of cooling circuits includes a first cooling circuit which abuts said pressure side wall; a second cooling circuit which abuts said suction side wall; and a third cooling circuit intermediate said first and second cooling circuits.

16. A turbine engine component comprising:

an airfoil portion having a pressure side wall, a suction side wall, a leading edge and a trailing edge;

a cooling system comprising an arrangement of chordwise overlapping cooling circuits, said arrangement of chordwise overlapping cooling circuits comprising a plurality of cooling circuits within said airfoil portion;

said cooling circuits being positioned between an interior surface of said pressure side wall and an interior surface of said suction side wall;

said plurality of cooling circuits each being supplied with cooling fluid from a first supply cavity;

each said cooling circuit having a plurality of spaced apart exit slots extending through said pressure side wall for distributing said cooling fluid over an external surface of said pressure side wall, each said cooling circuit being disposed longitudinally along the airfoil portion; and each of said cooling circuits having a plurality of internal staggered pedestals.

17. The turbine engine component according to claim 16, wherein said staggered pedestals in a first of said cooling circuits are offset from said staggered pedestals in a second of said cooling circuits adjacent to said first of said cooling circuits.

18. The turbine engine component according to claim 17, wherein said staggered pedestals in a third one of said cooling circuits are offset from said staggered pedestals in a third of said cooling circuits adjacent to said second of said cooling circuits.

19. The turbine engine component according to claim 16, further comprising a leading edge cooling circuit having a plurality of shaped exit slots extending through said pressure side wall from a location near a tip of said airfoil portion to a location near a platform of said turbine engine component.

20. The turbine engine component according to claim 19, further comprising a plurality of additional cooling slots extending through said pressure side wall located between said shaped exit slots and said exit slots of one of said cooling circuits.

21. The turbine engine component according to claim 20, wherein said additional cooling slots extend from another location near said tip to another location near said platform.

22. The turbine engine component of claim 16, wherein said arrangement of cooling circuits includes a first cooling circuit which abuts said pressure side wall; a second cooling circuit which abuts said suction side wall; and a third cooling circuit intermediate said first and second cooling circuits.

23. A method for forming a turbine engine component comprising:

forming an airfoil portion; and said forming step comprising forming an arrangement of chordwise overlapping cooling circuits having exit slots spaced chordwise along a pressure side wall of said airfoil portion wherein said overlapping cooling circuits are each supplied fluid from a first supply cavity, wherein each said cooling circuit has an inlet at a common chordwise point, wherein each said cooling circuit has at least one of said exit slots extending through said pressure side wall of said airfoil portion for distributing said cooling fluid over an external surface of said pressure side wall, and wherein each said cooling circuit extends longitudinally within said airfoil portion.

24. The method according to claim 23, wherein said at least one cooling circuit forming step further comprises forming each said cooling circuit with a plurality of staggered internal pedestals.

25. The method according to claim 24, wherein said at least one cooling circuit forming step comprises using at least one refractory metal core element to form each said cooling circuit.

26. The method according to claim 25, wherein said at least one cooling circuit forming step comprises using a plurality of refractory metal core elements to form said cooling circuits.

27. A method for forming a turbine engine component comprising:

forming an airfoil portion; and said forming step comprising forming at least one cooling circuit extending longitudinally within said airfoil portion and having at least one exit slot extending through a pressure side wall of said airfoil portion, wherein said at least one cooling circuit forming step comprises forming a plurality of longitudinally extending cooling circuits within said airfoil portion, wherein said at least one cooling circuit forming step further comprises forming each said cooling circuit with a plurality of staggered internal pedestals;

wherein said at least one cooling circuit forming step further comprises using at least one refractory metal core element to form each said cooling circuit;

wherein said at least one cooling circuit forming step comprises using a plurality of refractory metal core elements to form said cooling circuits; and wherein said at least one cooling circuit forming step comprises placing each of said refractory metal core elements within a mold.

28. The method according to claim 27, further comprising placing a ceramic core within said mold and attaching each of said refractory metal core elements to said ceramic core.

29. The method according to claim 28, further comprising forming a wax pattern in the shape of said turbine engine component and forming a ceramic shell around said wax pattern.

30. The method according to claim 29, further comprising removing said wax pattern and pouring molten metal into said mold to form said airfoil portion.

31. The method according to claim 30, further comprising allowing said molten metal to solidify and thereafter removing said refractory core elements.

32. The method according to claim 31, further comprising forming a plurality of shaped cooling fluid exit holes in a leading edge portion of said pressure side wall of said airfoil portion.

33. The method according to claim 32, further comprising forming a plurality of cooling fluid exit slots in an intermediate portion of said pressure side wall.

* * * * *